United States Patent [19]

Howe

[11] 4,116,054

[45] Sep. 26, 1978

[54] APPARATUS FOR MEASURING THE COMBINED RESISTANCE TO DISPLACEMENT OF STRINGS AFFIXED IN A RACKET HEAD

[76] Inventor: John G. Howe, Jamestown Star Rte., Boulder, Colo. 80302

[21] Appl. No.: 790,611

[22] Filed: Apr. 25, 1977

[51] Int. Cl.[2] ..... G01L 5/04

[52] U.S. Cl. ..... 73/145

[58] Field of Search ..... 73/144, 145, 100

[56] References Cited

U.S. PATENT DOCUMENTS

| | | | |
|---|---|---|---|
| 1,833,195 | 11/1931 | Albright, Jr. | 73/144 |
| 1,871,776 | 8/1932 | Chatillon | 73/144 |
| 3,310,981 | 3/1967 | Nixon et al. | 73/144 |

FOREIGN PATENT DOCUMENTS

| | | | |
|---|---|---|---|
| 567,476 | 12/1923 | France | 73/145 |

*Primary Examiner*—Charles A. Ruehl

*Attorney, Agent, or Firm*—Cushman, Darby & Cushman

[57] ABSTRACT

Apparatus for measuring the spring rate of the total string plane of a racket. A frame is provided for positioning the racket head. The frame supports a member which is movable towards the strings in a direction normal to its plane. A measuring device is interposed between the frame and the strings whereby when the strings are displaced from their normal plane as a result of movement of the member, the measuring device displays an indication representative of the strings' resistance to the displacement.

7 Claims, 2 Drawing Figures

APPARATUS FOR MEASURING THE COMBINED RESISTANCE TO DISPLACEMENT OF STRINGS AFFIXED IN A RACKET HEAD

BACKGROUND OF THE INVENTION

The present invention is concerned with the measurement of the combined resistance to displacement of strings affixed in rackets used for playing games such as tennis, squash, racketball, and the like. Resistance to displacement is an important parameter since it has a direct relationship to the capability of the racket to control the direction and speed of the ball when it is struck.

Conventionally, the longitudinal tension of an individual racket string is measured. For example, in U.S. Pat. No. 3,831,442, which issued to Millard M. Cummins, et al on Aug. 27, 1974, a string tension measuring device is disclosed which engages a string and provides an indication of that string's longitudinal tension. Similarly, machines used in stringing rackets typically include suitable measuring means for indicating the tension imparted to a particular string as it is placed on the racket frame.

While the measurement of longitudinal tension of a string is useful, it does not provide a completely meaningful indication of the ability of the string racket to perform its intended function since other factors contribute to the resistance to displacement of the plane of strings which serves as the playing surface of the racket. Such factors include the size and shape of the racket head, the longitudinal and torsional rigidity of the head, the type of string and stringing technique used, stringing machine error, grommet friction in the racket, string relaxation after use, etc.

SUMMARY OF THE INVENTION

The present invention overcomes the shortcomings of previously known string tension measuring devices of the type just discussed. More particularly, according to the invention, the resistance to displacement of the racket strings is measured by positioning the racket head on a frame which supports a member which is movable normal to the plane of the strings. A measuring device is positioned between the frame and the strings to provide an indication of the force generated by the strings in resistance to displacement caused by actuation of the movable member.

The invention will be described in further detail with reference to the accompanying drawings illustrating a preferred embodiment of the invention and wherein:

FIG. 1 is a perspective view illustrating a test frame for supporting a racket and a measuring device for providing an indication of the combined resistance to displacement of the strings; and FIG. 2 is a perspective view illustrating the orientation of the components of FIG. 1 as they are employed in testing the resistance to displacement.

DETAILED DESCRIPTION OF THE INVENTION

Figure 2:
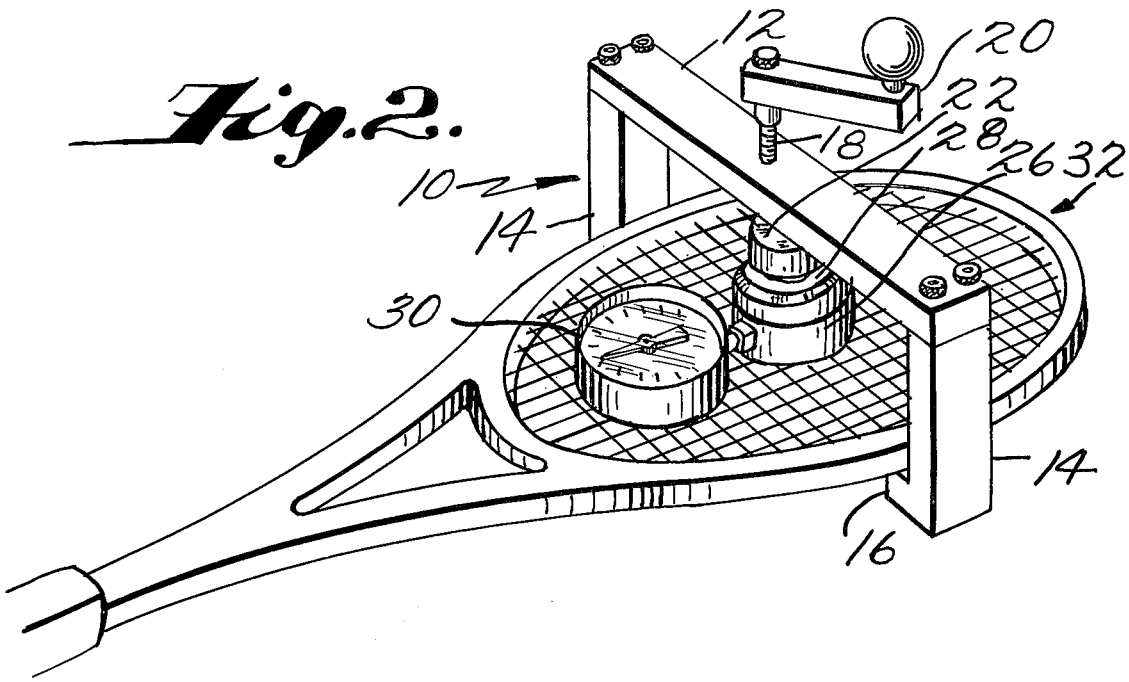

Referring to the drawings, the invention now will be described in detail.

Figure 1:
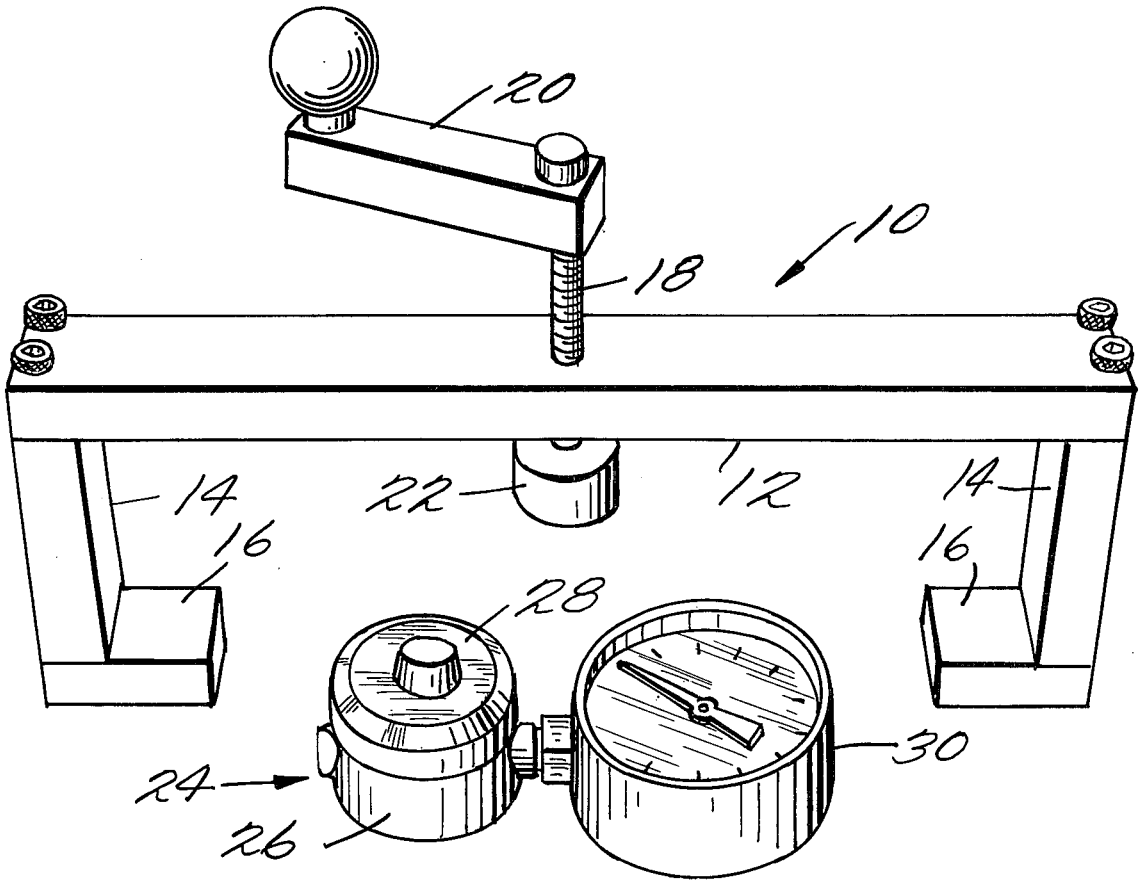

FIG. 1 illustrates a test frame 10 having an inverted U-shape. The frame includes a web portion 12 and arms 14 extending from opposite ends thereof. The free ends of arms 14 are provided with flanges 16 extending towards one another. These flanges serve as platforms upon which the edges of the racket frame may rest, as will be described hereinafter. The spacing between arms 14, as well as the length of each of the flanges 16, are designed such that frame 10 is capable of receiving rackets of different sizes.

At a central location along web portion 12 a threaded rod 18 passes through a correspondingly threaded aperture in the web. A conventional crank handle 20 is secured to one end of rod 18, and a disk-like element 22 is joined to the opposite end thereof.

The measuring device 24 illustrated in FIG. 1 preferably is of the type disclosed in U.S. Pat. No. 3,964,300, which issued to John G. Howe on June 22, 1976. This device comprises a substantially cylindrical fluid container 26 provided with a flexible diaphragm 28 at one end thereof. A pressure gauge 30 is joined to container 26 and is operatively related to the fluid within the container. Consequently, any pressure developed in the fluid due to force applied to diaphragm 28 results in a reading being produced on gauge 30.

The operation of the arrangement just described can best be appreciated by reference to FIG. 2.

A racket 32 is positioned with respect to test frame 10 such that the racket head rests on flanges 16 with the central portion of the racket strings being positioned beneath element 22. Measuring device 24 is interposed between element 22 and the strings with diaphragm 28 facing element 22. The crank handle 20 is then rotated to move element 22 normal to the plane of the strings into engagement with the diaphragm, while the opposite end of cylindrical container 26 contacts several racket strings in the central portion of the racket face. With the tension measuring apparatus so oriented and the gauge 30 reading zero, crank handle 20 is rotated a predetermined amount to thereby advance rod 18 and element 22 a fixed distance established by the lead of the threads of rod 18. This displacement of element 22 forces the measuring device 24 against the racket strings, thereby displacing them and deflecting the racket head in torsion. The resistance to displacement of the strings results in a force being exerted on diaphragam 28 and a reading being generated on gauge 30. The gauge reading after element 22 moves the predetermined distance therefore is representative of the combined resistance to displacement of the strings.

While in the preferred embodiment of the invention the measuring device 24 is in contact with the racket strings, it should be understood that an additional element for distributing force may be interposed between the device 24 and the strings. Alternatively, it is also possible for the measuring device to be mounted at the end of rod 18 in a manner whereby its diaphragm 28 is advanced into contact with a force-distributing element resting on the racket strings.

With the arrangement just described, the reading produced on the gauge of the measuring device 24 is representative of overall resistance to displacement of the strings as it is established by such factors as the type of string material used, the tension and stringing technique employed as the racket is strung, the shape and physical characteristics of the racket itself, etc. Thus, the reading produced by measuring device 24 is indicative of what the player can actually expect to feel as he hits the ball. Therefore, utilizing the testing arrangement of the present invention, a racket can be strung with the proper tension according to the skills of the player, regardless of the racket's physical characteristics and without concern for the variances which exist between the longitudinal string tension gauges associated with different stringing machines.

In addition to permitting a racket to be properly strung, the present invention can be used to test whether a racket should be restrung. The invention also can be used as a tool in evaluating various rackets in order to determine what the optimum string tension is for a particular player using a particular racket.

What is claimed is:

1. Apparatus for measuring the combined resistance to displacement of strings normally affixed in a plane within a racket head, said apparatus comprising:

an inverted U-shaped frame formed by a web portion and arms extending from opposite ends of the web, said arms being provided with respective flanges extending towards one another which are adapted to support the racket head at spaced locations about the head;

a member supported by the frame and movable in a direction normal to the plane of the strings when said racket head is supported by the flanges;

means for moving said member relative to the frame in said direction; and a measuring device adapted to be interposed between the movable member and said strings in contacting relationship therewith whereby movement of the member towards said strings is transmitted by the measuring device to cause displacement of the strings from said normal plane, the measuring device including means for providing an indication of the force involved in effecting said displacement.

2. Apparatus as set forth in claim 1, wherein said movable member comprises a threaded rod passing through a correspondingly threaded aperture in the web portion of said frame.

3. Apparatus as set forth in claim 2, wherein said moving means comprises a handle secured to one end of said rod for rotating the rod.

4. Apparatus as set forth in claim 3, wherein said measuring device is contacted by the other end of said rod.

5. Apparatus as set forth in claim 4, wherein said measuring device comprises a fluid container, said container having a flexible diaphragm portion operatively connected to the movable member for transmitting force to fluid within the container and a pressure gauge communicating with said fluid to provide an indication of the force applied to the diaphragm.

6. Apparatus as set forth in claim 1, wherein said measuring device comprises a fluid container, said container having a flexible diaphragm portion for transmitting force to fluid within the container, and a pressure gauge communicating with said fluid to provide an indication of the force applied to the diaphragm.

7. Apparatus as set forth in claim 6, wherein said diaphragm is operatively connected to the movable member.

* * * * *